US005401337A

United States Patent [19]

Carlson et al.

[11] Patent Number: 5,401,337

[45] Date of Patent: Mar. 28, 1995

[54] SECONDARY PROTECTIVE TREATMENTS FOR METAL SURFACES

[75] Inventors: Lawrence R. Carlson, Waterford; Philip M. Johnson, Southfield; John R. Pierce, Huntington Woods, all of Mich.

[73] Assignee: Henkel Corporation, Plymouth Meeting, Pa.

[21] Appl. No.: 146,243

[22] Filed: Nov. 1, 1993

Related U.S. Application Data

[63] Continuation-in-part of Ser. No. 74,091, Jun. 8, 1993, abandoned, which is a continuation of Ser. No. 685,355, Apr. 15, 1991, Pat. No. 5,226,976.

[51] Int. Cl.[6] ..... C23C 22/83

[52] U.S. Cl. ..... 148/257; 106/14.16; 148/265; 148/272

[58] Field of Search ..... 148/257, 258, 272; 106/14.16

[56] References Cited

U.S. PATENT DOCUMENTS 3,895,170 7/1975 Tanaka et al. ..... 428/457
3,964,936 6/1976 Das ..... 148/6.27

OTHER PUBLICATIONS

Product Bulletin—Igepal Co-850.
Product Bulletin—Mazon ® RI 4 A.
Product Bulletin—Polyglycol E-400.
Product Bulletin—Dowfax TM 2A1.
Product Bulletins—Cobratec ® CBT, Cobratec ® 99, Cobratec ® 700/725, Cobratec ® 1300.
Product Bulletins—Hostacor BM, Hostacor BS, Hostacor BF, Hostacor BBM.

*Primary Examiner*—Sam Silverberg
*Attorney, Agent, or Firm*—Ernest G. Szoke; Wayne C. Jaeschke; Norvell E. Wisdom, Jr.

[57] ABSTRACT

Seal coating compositions and methods of applying them to metallic surfaces, particularly aluminum or alloys thereof, beating a previously formed protective coating, particularly a conversion coating, such as a chromate or phosphate coating or a chrome-free metal oxide conversion coating, or a coating formed by anodization, provide improved corrosion resistance beyond that provided by the previously formed protective coating. The seal coating compositions preferably contain at least one of benzotriazole, nickel and/or cobalt cations and borates, or aminated polymers of vinyl styrene.

10 Claims, No Drawings

SECONDARY PROTECTIVE TREATMENTS FOR METAL SURFACES

CROSS-REFERENCE TO RELATED APPLICATIONS

This application is a continuation-in-part of application Ser. No. 074,091, filed Jun. 8, 1993, now abandoned which was a continuation of application Ser. No. 685,355, filed Apr. 15, 1991, and now U.S. Pat. No. 5,226,976. Except to the extent that it is inconsistent with any explicit statement herein, the entire disclosure of noted U.S. Pat. No. 5,226,976 is hereby incorporated herein by reference.

BACKGROUND OF THE INVENTION

1. Field of the Invention

This invention relates to the field of secondary protective surface treatment of articles with metal surfaces and to compositions, in particular liquid solutions or dispersions with a liquid continuous phase, which are used for such treatments. The treatments herein are described as "secondary" because they follow some other previously used protective treatment and enhance the overall protection achieved, particularly when further protective coatings including an organic binder are applied over the secondary treatments according to this invention.

2. Statement of Related Art

In the art of treating metal surfaces, it is common practice to improve the corrosion resistance characteristics and bonding of subsequent coatings to the metal surface by coating the metal surface with a primary protective coating or film, most often of the type commonly known as a conversion coating. In addition, there is usually an outermost coating of one or more of the types commonly known as paint, lacquer, enamel, or the like which, except for optional pigment or other coloring matter and finely divided filler materials, consist primarily of one or more organic binder.

In order to improve the qualities of the primary coating, it is common to provide a secondary coating or treatment before the outermost coating. For phosphate conversion coatings, for example, one of the most common secondary treatments has been with solutions containing hexavalent chromium, and other types of secondary treatments are also known. However, none of the previously known secondary treatments are fully satisfactory in every application, and it is an object of this invention to provide improved secondary treatments, particularly ones with less pollution potential than the conventional treatments with hexavalent chromium.

DESCRIPTION OF THE INVENTION

Other than in the operating examples and claims, or where otherwise indicated explicitly to the contrary, all numbers expressing quantities of ingredients or reaction conditions used herein are to be understood as modified in all instances by the term "about" in describing the broadest scope of the invention. Practice within the exact numerical limits given, however, is generally preferred.

Also, unless there is an explicit statement to the contrary: The description below of groups of chemical materials as suitable or preferred for a particular ingredient according to the invention implies that mixtures of two or more of the individual group members are equally as suitable or preferred as the individual members of the group used alone; the specification of chemical materials in ionic form should be understood as implying the presence of some counterions as necessary for electrical neutrality of the total composition; in general, such counterions should first be selected to the extent possible from the ionic materials specified as part of the invention; any remaining counterions needed may generally be selected freely, except for avoiding any counterions that are detrimental to the objects of the invention; "parts of", percentages, and ratio are by weight or mass; and the term "mole" may be applied to elemental and ionic materials and to chemical moieties as well to compounds with well characterized molecular structures.

SUMMARY OF THE INVENTION

In its narrower embodiments, this invention provides compositions and processes for secondary treatment of metal surfaces already bearing a primary protective coating or treatment. The underlying metal surfaces which may be treated in accordance with the present invention include any metal surface, particularly iron, zinc, magnesium, and the various types of steel surfaces, including galvanized steel, and aluminum and alloys thereof with metals such as copper, zinc, manganese, silicon and magnesium, all of which surfaces may be formed by plating on another substrate as well as continuations of the underlying base material of which the article containing the treated surface is constructed. The invention is applicable immediately over any type of primary coating (except a plating of one metal or alloy over another), but is particularly suitable over (i) conversion coatings, such as the chromate and/or phosphate coatings commonly employed on aluminum or aluminum alloys and on steel and galvanized steel, (ii) the more recently developed chrome-free coatings of the type taught in U.S. Pat. No. 3,964,936 and (iii) oxide coatings formed on aluminum and magnesium and alloys consisting of at least 45 atomic percent of one of these metals, particularly such coatings formed by anodization, and still more particularly those which have a porous microstructure including cells, with relatively thin walls and relatively wide hollows within the walls, extending upward from the metal surface, the lower levels of the cells forming a barrier layer at the interface between the metal and the coating or film. The coating compositions of the present invention are particularly effective in sealing such cellular pore structures, the compositions according to the invention extending into the pores, with the penetration and depth into the core affecting the degree of protection provided by the secondary coating. Because of this effect of filling pores in porous primary coatings, the secondary treatments described herein are sometimes called "seal" or "sealing" treatments below. Seal coating treatments according to the invention are particularly useful for aluminum and aluminum alloy substrates of the type used in aircraft bodies, some automobile bodies and other parts, and architectural siding.

Secondary coating compositions according to this invention are aqueous liquid compositions that comprise, preferably consist essentially of, or most preferably consist of, water and at least one of components (I)–(III), where:

(I) is a combination of:

(A) at least one of nickel, cobalt, and manganese divalent cations, preferably nickel and at least one of cobalt and manganese;

(B) a subcomponent selected from the group consisting of boric acid and condensed boric acids and their salts, preferably from the group consisting of $H_3BO_3$ and its salts, or more preferably $H_3BO_3$ only; and (C) nitrate anions, preferably from ammonium nitrate;

(II) is water soluble triazoles, optionally but preferably in combination with at least one of, and more preferably with all of:

(A) other water soluble corrosion inhibitors for aluminum, preferably including at least one of (i) other azoles, (ii) the boron complexes sold commercially by Hoechst-Celanese Corporation under the tradename HOSTACOR and (iii) the inhibitors sold commercially by PPG Industries, Inc. under the tradename MAZON TM;

(B) water soluble poly{oxyalkylenes}, preferably poly{oxyethylenes} and poly{oxypropylenes}, most preferably poly{oxyethylene} (which is also commonly known as poly{ethylene glycol}) with a molecular weight in the range from 100 to 1000;

(C) surfactants, preferably including at least one of (i) alkyl phenol alkoxylates, preferably nonyl phenol ethoxylates with a hydrophilelipophile balance ("HLB") in the range from 15.0 to 17.0, (ii) anionic surfactants, preferably those having at least one sulfonate substituent in each phenyl ring of a hydrophobe substituted diphenyl oxide "backbone", and (iii) adducts of ethylene oxide with fatty amines, preferably adducts of an average of 12 molecules of ethylene oxide with each molecule of amines having the mixture of alkyl groups derived from natural coconut oil; and (III) is selected from the group consisting of water soluble and water dispersible Polymer Materials a, b, and c as characterized below and their salts with both acids and bases.

Polymer Material a is a homo-or co-polymer having at least one repeating unit corresponding to the formula:

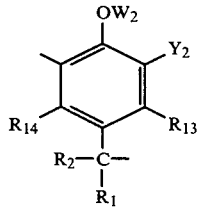

wherein:

each of $R_1$, $R_2$, $R_{13}$ and $R_{14}$ is independently selected for each repeating unit from hydrogen, an alkyl group having from 1 to 5 carbon atoms, or an aryl group having 6 to 18 carbon atoms;

$Y_2$ is independently selected for each repeating unit from hydrogen, "Z" as defined below, $—CR_{11}R_5OR_6$, $—CH_2Cl$, or an alkyl or aryl group having from 1 to 18 carbon atoms; at least one $Y_2$ in at least one of the repeating units is Z; and Z is:

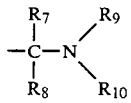

or

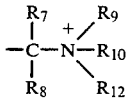

wherein each of $R_5$ through $R_{12}$ (with a possible exception for $R_{12}$ as noted below) is independently selected within each repeating unit and independently selected for each repeating unit from hydrogen, an alkyl, an aryl, a hydroxy-alkyl, an amino-alkyl, a mercapto-alkyl, or a phospho-alkyl moiety; preferably one of $R_9$ and $R_{10}$ is a polyhydroxyalkyl moiety such that the Z moiety as a whole has a structure that could result from the condensation of an amine or ammonia with a ketose or aldose having from 3 to 8 carbon atoms, followed by reduction to an amino group. Preferably, $R_1$ and $R_7$ through $R_{12}$ have, in total, carbon chain lengths up to but not including lengths at which the compound is no longer soluble or dispersible in water. $R_{12}$ can also be $—O^{(-1)}$ or —OH (oxygen or hydroxy) in order to form an amine oxide or a hydroxyl amine;

$W_2$ is independently selected for each repeating unit from the group consisting of hydrogen; an acyl; an acetyl; a benzoyl; a 3-allyloxy-2-hydroxy-propyl-; a 3-benzyloxy-2-hydroxy-propyl-; a 3-alkylbenzyloxy-2-hydroxy-propyl-; a 3-phenoxy-2-hydroxy-propyl-; a 3-alkylphenoxy-2-hydroxy-propyl-; a 3-butoxy-2-hydroxy-propyl; a 3-alkyloxy-2-hydroxy-propyl; a 2-hydroxyoctyl-; a 2-hydroxy-alkyl-; a 2-hydroxy-2-phenyl ethyl-; a 2-hydroxy-2-alkyl phenyl; an iso-propenyl-; a propenyl-; a benzyl-; an alkyl; an allyl; an alkyl benzyl-; a haloalkyl-; a haloalkenyl; a 2-chloro-propenyl-; a sodium; a potassium; a tetra aryl ammonium; a tetraalkyl ammonium; a tetra alkyl phosphonium; a tetra aryl phosphonium; or a condensation product of ethylene oxide, propylene oxide, or a mixture or copolymer thereof.

It will be appreciated that the depiction above represents a repeating unit that characterizes the compound or materials of the present invention; no terminating end units are depicted. The end groups of the polymers of the present invention can be selected by the skilled artisan relying upon art-disclosed techniques. For example, the end groups of the polymer may either be those resulting from the specific polymerization process employed or those intentionally added to alter the polymer characteristics. For example, the end groups may be hydrogen, hydroxyl, initiation fragments, chain transfer agents, disproportionation groups, or groups resulting from other methods of terminating a growing polymer chain.

Polymer Material b comprises homopolymers and copolymers of alkenylphenols and substituted alkenylphenols, optionally co-polymerized with one or more other types of monomers. Preferably the comonomers if used possess an ethylenically unsaturated C=C bond. The alkenylphenolic or substituted alkenylphenolic moieties of the homopolymer or copolymer compositions have the following structure (after having been polymerized):

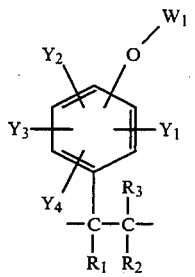

wherein:

each of $R_1$ through $R_3$ is independently selected within each repeating unit and independently selected for each repeating unit from hydrogen, an alkyl group having from 1 to 5 carbon atoms, or an aryl group having from 6 to 18 carbon atoms;

each of $Y_1$ through Y4 is independently selected within each repeating unit and independently selected for each repeating unit from hydrogen, Z, —$CR_4R_5OR_6$, —$CH_2Cl$, or an alkyl or aryl group having from 1 to 18 carbon atoms; at least a fraction, with increasing preference at least 1%, one sixth, or one half, of the total of the $Y_1$ through $Y_4$ units is Z, as already defined above;

$R_4$ through $R_{12}$ (with a possible exception for $R_{12}$ as noted below) are independently selected within each repeating unit and independently selected for each repeating unit from hydrogen, an alkyl, an aryl, a hydroxy-alkyl, an amino-alkyl, a mercapto-alkyl, or a phospho-alkyl moiety. Preferably, all the "R"'s have carbon chain lengths up to a length at which the compound is no longer soluble or dispersible in a suitable surface treatment carrier, such as water. $R_{12}$ can also be —$O^{(-1)}$ or —OH in order to form an amine oxide or hydroxyl amine;

$W_1$ is independently selected for each repeating unit from the group consisting of a hydrogen; an acyl moiety; a acetyl; a benzoyl; a 3-allyloxy-2-hydroxy-propyl-; a 3-benzyloxy-2-hydroxy-propyl-; a 3-alkylbenzyloxy-2-hydroxy-propyl-; a 3-phenoxy-2-hydroxy-propyl-; a 3-alkylphenoxy-2-hydroxy-propyl-; a 3-butoxy-2-hydroxy-propyl; a 3-alkyloxy-2-hydroxy-propyl-; a 2-hydroxyoctyl-; a 2-hydroxyalkyl-; a 2-hydroxy-2-phenyl-ethyl-; a 2-hydroxy-2-alkyl-phenylethyl-; a benzyl-; an alkyl-; an allyl-; an alkylbenzyl-; a haloalkyl-; or a haloalkenyl such as 2-chloropropenyl-; or a condensation product of ethylene oxide, propylene oxide, or a mixture or copolymer thereof.

Materials having C=C moieties and other useful copolymerizable monomer components for use in the present invention can be selected from a variety of unsaturated materials as illustrated in the following list. The material may be selected from the group consisting of acrylonitrile, methacrylonitrile, methyl acrylate, methyl methacrylate, vinyl acetate, vinyl methyl ketone, isopropenyl methyl ketone, acrylic acid, methacrylic acid, acrylamide, methacrylamide, n-amyl methacrylate, styrene, m-chlorostyrene, o-chlorostyrene, p-chlorostyrene, n-decyl methacrylate, N,N-diallylmelamine, N,N-di-n-butylacrylamide, di-n-butyl itaconate, di-n-butyl maleate, diethylaminoethyl methacrylate, diethyleneglycol monovinyl ether, diethyl fumarate, diethyl itaconate, diethyl vinylphosphonate, vinylphosphonic acid, diisobutyl maleate, diisopropyl itaconate, diisopropyl maleate, dimethyl fumarate, dimethyl itaconate, dimethyl maleate, di-n-nonyl fumarate, di-n-nonyl maleate, dioctyl fumarate, di-n-octyl itaconate, di-n-propyl itaconate, n-dodecyl vinyl ether, ethyl acid fumarate, ethyl acid maleate, ethyl acrylate, ethyl cinnamate, N-ethylmethacrylamide, ethyl methacrylate, ethyl vinyl ether, 5-ethyl-2-vinylpyridine, 5-ethyl-2-vinylpyridine 1-oxide, glycidyl acrylate, glycidyl methacrylate, n-hexyl methacrylate, 2-hydroxyethyl methacrylate, 2-hydroxypropyl methacrylate, isobutyl methacrylate, isobutyl vinyl ether, isoprene, isopropyl methacrylate, isopropyl vinyl ether, itaconic acid, lauryl methacrylate, methacrylamide, methacrylic acid, methacrylonitrile, N-methylolacrylamide, N-methylolmethacrylamide, N-alkoxymethylacrylamide, N-alkoxymethylmethaerylamide, N-butoxymethylmethacrylamide, N-vinyl-caprolactam, methyl acrylate, N-methylmethacrylamide, m-methylstyrene, o-methylstyrene, p-methylstyrene, 2-methyl-5-vinylpyridine, n-propyl methacrylate, sodium p-styrene sulfonate, stearyl methacrylate, styrene, p-styrene sulfonic acid, p-styrenesulfonamide, vinyl bromide, 9-vinylcarbazole, vinyl chloride, vinylidene chloride, 1-vinylnaphthalene, 2-vinylnaphthalene, 2-vinylpyridine, 4-vinylpyridine, 2-vinylpyridine N-oxide, 4-vinylpyrimidine, and N-vinylpyrrolidone. Mixtures of these materials may also be employed.

It will be appreciated by those skilled in the an that the alkenylphenolic moieties of the present invention can be either randomly distributed within the copolymer (a term used herein to include any number of monomers in excess of one) or can be synthesized to constitute a block polymer, depending upon the methods and conditions used for polymerization. Within such materials, the ratio of any single monomer to any other monomer can be about 1:99 to about 99:1, preferably about 5:1 to about 1:5, and more preferably 1.5:1 to about 1:1.5.

Polymer Material c - Condensation Polymers

A "condensation polymer", for the purposes of this description, is a material wherein forms of Polymer Materials a or b as defined above, or mixtures thereof, which have been modified if necessary to be condensable as noted below, are condensed with a second compound selected from the group consisting of phenols and substituted phenols (preferably phenol itself, alkyl phenols, aryl phenols, cresol, resorcinol, catechol, or pyrogallol), tannins (both hydrolyzable or condensed), novolak resins, lignin compounds, and mixtures thereof, together with an aidehyde, ketone, or mixture thereof, to produce a condensation resin prepolymer product that is a prepolymer of Polymer Material c. The condensable or modified starting materials are modified by initially excluding the "Z" moiety prior to initiating condensation; an additional modification to make the starting materials condensable will also be appreciated as necessary in that Y1 through Y4 cannot be Z, —CR11R5OR6, or —CR4R5OR6. The "Z" moiety (as described above) is then added later to these condensation prepolymers by further reacting the condensation resin with (1) an aldehyde, ketone, or mixtures thereof, and (2) a secondary amine to produce an adduct which can react with acid and/or can be reacted with hydrogen peroxide to generate an amine oxide and can be used in water or in an organic solvent. If desired the amine oxide can be acid neutralized to form the hydroxylamine.

While this condensation product is described for convenience as being prepared by a sequential reaction, it will be appreciated that these materials can be prepared by carrying out the necessary steps in any order, or simultaneously. However, the sequence described is preferred.

Broader process embodiments of the present invention may include conventional cleaning of the metal surface, rinsing, formation of the primary protective coating, drying, and the like before the secondary coating and rinsing, drying, painting, and the like subsequent to the secondary treatment. Composition embodiments of the invention include not only working compositions useful directly for treatments according to the invention, but also concentrate compositions from which such working compositions may be prepared by dilution with water, usually and preferably by dilution with water only.

DESCRIPTION OF PREFERRED EMBODIMENTS

After the secondary coating solution has been applied to the metal surface, it is generally rinsed with water, preferably including a deionized water rinse after which the coated article is dried, conveniently in an oven having forced circulation of hot air typically at temperatures up to 235° C. for metals generally with temperatures of up to about 95° C. preferred for aluminum and magnesium. Other available drying methods can be used, including air drying at ambient temperatures, usually about 20°–23° C.

The treating compositions of the present invention in working solution form preferably contain from 25–5000 parts per million by weight (hereinafter often abbreviated "ppm"), preferably 500–2000 ppm of the active components as described above.

When component (I) as described above is used, nickel and manganese if used are preferably added to the formulation as their sulfate salts, more preferably as their hexahydrated and monohydrated sulfate salts respectively, and cobalt if used is preferably added as a nitrate salt, more preferably its nitrate hexahydrate. The total amount of cobalt, manganese, and nickel salts in a concentrated composition according to the invention, from which a working composition may be prepared by dilution with water, preferably with water only, is preferably in the range from 12 to 20 grams per liter (often abbreviated hereinafter as "g/L"). When both nickel and cobalt or manganese are used, as is preferred, the ratio by weight of the nickel to the total of cobalt and manganese preferably is within the range from 1:5 to 5:1, more preferably within the range from 1:2 to 2:1, or still more preferably within the range from 1:1.3 to 1.3:1.

The amount of subcomponent (I)(B) used in a concentrate including component (I) preferably is from 15 to 25 g/L; independently, the ratio of the amount of subcomponent (I)(B) to the amount of each of subcomponents (I)(A) and (I)(C) preferably is within the range from 1.2:1 to 1.0:1. For the purposes of this ratio, each of subcomponents (I)(A) and (I)(C) is to be considered to include counterions as well as the ionic ingredients specified above. Also, independently of the other preferences stated herein, the concentration of ammonium nitrate, when that salt is used for subcomponent (I)(C) as preferred, is within the range from 15 to 30 g/L. Seal compositions of this type (I) generally provide the most desirable results at pH levels above 4 to about 7, i.e., 4.5 to 7, with optimum results generally within a pH range of about 5–6.

The most preferred inorganic concentrate compositions according to type (I) of the invention have one of the following formulations:

| Formulation | Components | g/L |
|---|---|---|
| I-a | $NiSO_4.6H_2O$ | 8 |
| | $MnSO_4.H2O$ | 8 |
| | $H_3BO_3$ | 20 |
| | $NH_4NO_3$ | 16 |
| I-b | $NiSO_4.6H_2O$ | 8 |
| | $Co(NO_3)_2.6H_2O$ | 8 |
| | $H_3BO_3$ | 20 |
| | $NH_4NO_3$ | 16 |

Preferred triazoles for component (II) are those containing up to 18 carbon atoms per molecule, more preferably aryl triazoles containing 6–10 carbon atoms, such as benzotriazole and tolyltriazole, or alkyl triazoles containing 1–6 carbon atoms in the alkyl group, such as methyl triazole; these preferred triazoles may optionally contain carboxyl groups. Many of the preferred types of triazoles are commercially available from PMC Specialties Group, Inc., Cincinnati, Ohio under the tradename "COBRATEC", for example COBRATEC TM 700, 725, 99 or TT-100. Benzotriazole (COBRATEC TM 99), CAS Registry No. 95-14-7, is available as off-white to light yellow colored flakes, and tolyltriazole (COBRATEC TM TT-100), CAS Registry No. 29385-43-1, is available as tan to light brown granules.

Triazoles are preferably employed in a working immersion treatment bath according to this invention in a concentration within the range from 25–5000 ppm, or preferably from 500 to 2000 ppm. The pH of the triazole treating solutions as used for treatment preferably is in the range from 5–12 and may be adjusted into that range if needed by conventional addition of appropriate acid or base.

The ratios of the optional but preferred components to the necessary triazole component of a composition of type (II) according to the invention are preferably within the following ranges: Other corrosion inhibitors to benzotriazoles within the range from 0.5:1 to 1:0.4; total surfactants to benzotriazole within the range from 0.3:1.0 to 1.0:1.0; and polyoxyalkylenes to benzotriazole within the range from 2.0:1.0 to 5.0:1.0. The most preferred concentrate compositions according to this embodiment of the invention have the following compositions:

| | Parts by Weight in Composition: | |
|---|---|---|
| | II-1 | II-2 |
| Benzotriazole (COBRATEC TM 99) | 40.0 | 30.0 |
| Other azoles (COBRATEC TM 700 or 725) | 40.0 | 10.0 |
| MAZON TM RI 4A | 50.0 | 30.0 |
| Nonylphenolethoxylate surfactant (IGEPAL TM CO-850) | 10.0 | — |
| Disulfonated diphenyloxide surfactant (DOWFAX 2A1) | 10.0 | — |
| Ethoylated fatty amine surfactant (CHEMEEN TM C-12-G) | — | 20.0 |
| Polyoxyethylene with a molecular weight of 400 | 150.0 | 150.0 |
| + Deionized water to make up to 1000 total parts in each composition. | | |

The polyphenol compounds of component (III) as described above are particularly effective for secondary treatment or sealing of anodic and similarly formed oxide layers on aluminum and magnesium, not formed by conversion coating. In the Z moiety defined earlier, moleties conforming to the formula without any $R_{12}$ group are preferred, and one of $R_9$ and $R_{10}$ is preferably methyl and the other polyhydroxyalkyl as already defined, with the remaining groups $R_7$ and $R_8$ being hydrogen. When component (III) is the only one of components (I)–(III) that is present in a treatment composition according to this invention, the treatment composition preferably has a pH within the range from 0.5 to 14, preferably from 3 to 12, more preferably from 6–10, at the time of application generally giving more desirable results.

In each of the treatment compositions of the present invention, the composition comprises an effective amount of at least one of the components (I)–(III) dissolved and/or dispersed in a carrier suitable for surface treatment of the previously primary coated metal surface. Generally, the carrier is water in which the active treatment components are soluble or dispersible. However, small amounts of polar organic solvents, such as alcohols and/or glycols including glycol ethers, may be employed in the carrier along with water to promote solubility and dispersibillty.

Ideally, the secondary treatment according to this invention is carried ont after the initial primary treatment on the metal surface, with no drying step required after the primary coating is applied and before the secondary coating. After application of the secondary coating composition, the treated surface is preferably rinsed before drying;, however, good results can be obtained without rinsing for many end uses.

The thickness of the final dry coating, including the primary coating, on the metal surface will depend on its purpose or function(s) and will preferably range from about 0.0025 micrometers (hereinafter often abbreviated "μm") to 2.0 μm, more preferably from 0.010 to 1.0 μm.

The concentration of active ingredients in the seal treatment compositions can vary over a relatively wide range. Preferable levels will range from 0.001% up to 10%, or more preferably up to 5%. Concentrations of 0.001% to 2%, or better to 1%, are still more preferred.

Treatments according to the invention may be applied by any manner, including immersion or dipping, spray coating, roller coating, wiping or brushing, and the like. If useful to prevent excessively fast drainage from some substrate to be treated, the compositions can be made thixotropic by means known in the art, such as addition of a suitable acrylic latex. Temperatures during treatment can vary over a wide range, but preferably are from 21° to 104° C. In an immersion application, times of from 5 to 30 minutes will generally be adequate. The time of application can be reduced substantially, however, by other application methods, such as spray coating and in favorable cases even where immersion is used.

Further appreciation of the present invention can be had from the following examples. As used herein "salt spray" refers to salt spray corrosion resistance measured in accordance with ASTM-B 117-61. In reporting the results, the numerical rating of 10 would indicate no pits in the surface, a rating of 9 indicates up to about 2 pits, and a rating of 5 indicating about 20–30 pits. A rating of 0 would indicate a number of pits of about 100 or more.

EXAMPLES

In order to illustrate and evaluate the improved corrosion resistance employing the seal coating compositions of the present invention, 7.6 by 12.7 centimeter rectangular samples of 2024 T3 aluminum alloy, 0.81 millimeters in thickness, coated with a chrome-free conversion coating were coated with the seal coating compositions of the present invention as described below in more detail. The starting samples were prepared by conventional means including degreasing, cleaning, etching and deoxidizing, desmutting, rinsing and a non-chrome containing coating applied by immersion for 30 minutes at about 52° C. followed by an immersion rinse at 60° C. for 5 minutes. The samples were then seal coated by immersion in the aqueous solution of the present invention for 15 minutes at 82° C. followed by an immersion rinse in tap water for 3 minutes at ambient temperature (about 23° C.). The samples were then air dried at ambient temperature.

The seal coating formulations employed aqueous solutions with compositions as noted further below.

Compositions I-a and I-b as described above were prepared for use by adding a small amount of potassium hydroxide to adjust the pH value to 5.5. Compositions II-a and II-b as described above were diluted with water sufficiently to result in a benzotriazole content of 2.0 g/l. Formulation III-a was an aqueous solution of polymer in water at a concentration of 2% by weight, which had a pH of 6.7. The polymer was PARCOLENE TM 95AT of Parker+Amchem Division of Henkel Corporation, a methyl glueamine derivative of a poly (vinylphenol) resin (Resin M obtained from Maruzen Oil having a molecular weight of about 5000).

The results of the ASTM salt spray tests with these formulations are given in Table 1 below, the ratings being an average of testing of 10 panels in accordance with the ASTM method for each listed composition.

TABLE 1

| Seal Coat Made with | 168 Hour Salt Spray Test Results | |
|---|---|---|
| Formulation: | Rating Number | Number of Pits |
| I-a | 9 | 0–2 |
| I-b | 9 | 0–2 |
| II-a | 10 | 0 |
| II-b | 10 | 0 |
| IIII-a | 10 | 0 |
| No Seal Coating | 0 | >100 |

The foregoing results illustrate the improved corrosion resistance by the seal coatings of the present invention. Photomicrographs (10,000X and 50,000X) of the panels containing the chrome-free protective coating used in these examples before sealing reveal a tubular pore structure in which the cells containing the pores are of circular or oval cross section, extending upwardly from the aluminum surface, the bottoms of cells forming a barrier layer above the surface of the aluminum. As can be seen from the results above, this barrier layer is insufficient to provide significant corrosion resistance, the panels without any seal coat failing within 168 hours. In contrast, the panels containing the same initial chrome-free coating, when sealed with the compositions of the present invention, provided significant resistance to corrosion showing virtually no pits for ratings on the order of 9–10, after exposure to salt spray for 168 hours.

The invention claimed is:

1. A process for increasing the corrosion resistance of a metal object bearing a pre-existing protective coating, said process comprising steps of:

(I) contacting the pre-existing coating with a sealing composition consisting essentially of water and;

(A) benzotriazole and, optionally, one or more of the following;

(B) other water soluble corrosion inhibitors for aluminum;

(C) water soluble poly{oxyalkylenes}; and (D) surfactants; and (II) drying the metal object after completion of step (A).

2. A process according to claim 1, wherein, in the sealing composition, the ratio of component (C) to component (A) is within the range from about 2.0:1.0 to about 5.0:1.0 and the ratio of component (D) to component (A) is within the range from about 0.3:1.0 to about 1.0;1.0 and the concentration of benzotriazole is within the range from about 25 to about 5000 ppm; the temperature of the sealing composition is between about 21° and about 93° C., and the pH of the sealing composition is within the range from about 5 to about 12.

3. A process according to claim 2, wherein, in the sealing composition, the ratio of component (B) to component (A) is within the range from about 0.5:1 to about 1:0,4.

4. A process according to claim 3, wherein, in the sealing composition, component (C) consists essentially of poly{oxyethylenes}, poly{oxypropylenes}, or both and component (D) includes at least one of (i) alkyl phenol alkoxylates, (ii) anionic surfactants, and (iii) adducts of ethylene oxide with fatty amines.

5. A process according to claim 4, wherein, in the sealing composition, component (C) consists of poly{oxyothylene} with a molecular weight in the range from about 100 to about 1000 and component (D) includes at least one of (i) nonyl phenol ethoxylates with a hydrophile-lipophile balance ("HLB") in the range from 15.0 to 17.0, (ii) surfactants having at least one sulfonate substituent in each phenyl ring of a hydrophobe substituted diphenyl oxide "backbone", and (iii) adducts of an average of about 12 molecules of ethylene oxide with each molecule of amines having the mixture of alkyl groups derived from natural coconut oil; and step (II) is performed at temperature not greater than 232° C.

6. A process according to claim 2, wherein, in the sealing composition, component (C) consists essentially of poly{oxyethylenes}, poly{oxypropylenee}, or both and component (D) includes et least one of (i) alkyl phenol alkoxylates, (ii) anionic surfactants, and (iii) adducts of ethylene oxide with fatty amines.

7. A process according to claim 6, wherein, in the sealing composition, component (C) consists of poly{oxyethylene} with a molecular weight in the range from about 100 to about 1000 and component (D) includes at least one of (i) nonyl phenol ethoxylates with a hydrophile-lipophile balance ("HLB") in the range from 15.0 to 17.0, (ii) surfactants having at least one sulfonate substituent in each phenyl ring of a hydrophobe substituted diphenyl oxide "backbone", and (iii) adducts of an average of about 12 molecules of ethylene oxide with each molecule of amines having the mixture of alkyl groups derived from natural coconut oil.

8. A process according to claim 1, wherein the sealing composition consists essentially of composition II-1 or II-2, wherein these compositions have the following ingredients:

| | Parts by Weight In Composition: | |
|---|---|---|
| | II-1 | II-2 |
| Benzotriazole (COBRATEC TM 99) | 40.0 | 30.0 |
| Other azoles (COBRATEC TM 700 or 725) | 40.0 | 10.0 |
| MAZON TM RI 4A | 60.0 | 30.0 |
| Nonylphenolethoxylate surfactant (IGEPAL TM CO-850) | 10.0 | — |
| Disulfonated diphanyloxide surfactant (DOWFAX 2A1) | 10.0 | — |
| Ethoxylated fatty amino surfactant (CHEMEEN TM C-12-G) | — | 20.0 |
| Polyoxethylene with a molecular weight of 400 | 150.0 | 150.0 |
| + Deionized water to make up to 1000 total parts in each composition; | | |

the temperature of the sealing composition is between about 21° and about 93° C., the pH of the sealing composition is within the range from about 5 to about 12; and step (II) is performed at temperature not greater than 232° C.

9. A process according to claim 8, wherein the sealing composition is II-1 and step (II) is performed at temperature not greater than 93° C.

10. A process according to claim 8, wherein the sealing composition is II-2 and step (II) is performed at temperature not greater than 93° C.

* * * * *

UNITED STATES PATENT AND TRADEMARK OFFICE

CERTIFICATE OF CORRECTION

PATENT NO. : 5,401,337

DATED : Mar. 28, 1995

INVENTOR(S) : Carlson et al.

It is certified that error appears in the above-indentified patent and that said Letters Patent is hereby corrected as shown below:

In claim 3, column 11, line 27, "1:0,4", should read:
-- 1:0.4 --.

In claim 8, column 12, approximately line 28, "60.0", should read:
-- 50.0 --.

In claim 8, column 12, approximately line 30, "diphanyloxide", should read:
-- diphenyloxide --.

In claim 8, column 12, approximately line 34, "Polyoxethylene", should read:
-- Polyoxyethylene --.

Signed and Sealed this

Fifth Day of September, 1995

*Attest:*

*Attesting Officer*

Bruce Lehman

BRUCE LEHMAN

*Commissioner of Patents and Trademarks*